US005957049A

United States Patent [19]

Ammeter et al.

[11] Patent Number: 5,957,049

[45] Date of Patent: Sep. 28, 1999

[54] METHOD CONTROLLING INK APPLICATION IN A PRINTING PRESS

[75] Inventors: Harald Ammeter, Zurich; Hans Ott, Regensdorf, both of Switzerland; Nikolaus Pfeiffer, Heidelberg; Manfred Schneider, Bad Rappenau, both of Germany

[73] Assignee: Heidelberger Druckmaschinen, Heidelberg, Germany

[21] Appl. No.: 09/186,858

[22] Filed: Nov. 5, 1998

[30] Foreign Application Priority Data

Nov. 6, 1997 [DE] Germany ..... 197 49 066

[51] Int. Cl.[6] ..... B41F 31/00

[52] U.S. Cl. ..... 101/211; 101/484; 101/365

[58] Field of Search ..... 101/365, 484, 101/211, 206, 207, 208, 349.1, 350.1, 363; 702/108, 81; 356/425, 407, 408, 402, 406, 394, 71; 358/523; 250/559.04, 559.05, 559.39; 395/106, 102, 109; 382/165, 162, 164

[56] References Cited

U.S. PATENT DOCUMENTS

| | | | |
|---|---|---|---|
| 4,649,502 | 3/1987 | Keller et al. | 356/402 X |
| 4,884,221 | 11/1989 | Sugiyama et al. | 382/165 |
| 5,384,859 | 1/1995 | Bolza-Schunemann et al. . | |
| 5,530,656 | 6/1996 | Six . | |

FOREIGN PATENT DOCUMENTS

| | | |
|---|---|---|
| 228 347 | 7/1987 | European Pat. Off. . |
| 42 06 366 | 2/1993 | Germany . |
| 43 08 857 | 9/1994 | Germany . |
| 43 35 229 | 4/1995 | Germany . |
| 44 31 270 | 4/1995 | Germany . |
| 44 15 486 | 11/1995 | Germany . |
| 195 15 499 | 10/1996 | Germany . |
| 196 50 223 | 6/1998 | Germany . |

*Primary Examiner*—J. Reed Fisher
*Attorney, Agent, or Firm*—Kenyon & Kenyon

[57] ABSTRACT

In order to control ink application in a printing press, a sheet (3) printed by the printing press (1) is colorimetrically measured in a number of pixels (4) with respect to a selected color coordinate system that has been expanded to be four-dimensional by also taking into account an infrared component. Color difference vectors with respect to the desired color vectors, predefined or determined from a reference sheet (3) and referred to the same color coordinate system, are computed from the color vectors obtained for each pixel (4). A sensitivity matrix is determined for each measured pixel (4) of the sheet (3). The pixels (4) are classified by sensitivity class. The color difference vectors and sensitivity matrices of the pixels (4) pertaining to the same sensitivity class are averaged for each sensitivity class, and input parameters, in particular film thickness modification vectors, are computed from the averaged color difference vectors and averaged sensitivity matrices of all sensitivity classes for a control unit (9) of the inking mechanisms of the printing press (1). The inking of the printing press (1) is then controlled on the basis of the input parameters thus computed.

19 Claims, 2 Drawing Sheets

METHOD CONTROLLING INK APPLICATION IN A PRINTING PRESS

FIELD OF THE INVENTION

The present invention concerns a method of controlling ink application in a printing press.

RELATED TECHNOLOGY

Methods for controlling ink application in a printing press referred to as color difference control methods are disclosed, for example, in European Patent No. 0 228 347 B2 and German Patent No. 195 15 499 C2. In these methods, a printed sheet printed using a printing press is colorimetrically measured in a number of test areas with reference to a selected color coordinate system. The color difference vectors with respect to the desired color coordinates referenced to the same color coordinate system are calculated from the color coordinates thus determined. These color difference vectors are converted into film thickness modification vectors with the help of sensitivity matrices, and inking of the printing press is controlled on the basis of the film thickness modification vectors calculated from the color difference vectors. The fields of the color control strips printed together with the actual image are used as test areas.

Meanwhile, scanning devices have become known, which allow the entire image content of a printed sheet to be colorimetrically or spectrophotometrically measured in a large number of relatively small pixels at a reasonable cost and in a very short time. These scanning devices provide, in principle, the measuring conditions required for using not only test strips printed with the image for controlling inking in a printing press, but also for using the color information from all the pixels of the entire actual printed image for this purpose. One difficulty in this procedure (known as in-image measurement) is the problem of the black component present in four-color printing, to which, as known, not only the actual black ink, but also the chromatic colors printed one over the other, contribute. Conventional methods do not allow the color value gradients, required for calculating the input parameters for color adjustment, to be reliably determined for all the widely different printing situations occurring in a printed image. The enormous computing resources required and the resulting unreasonably long computing times represent another difficulty.

SUMMARY OF THE INVENTION

Based on this related art, an object of the present invention is to provide an ink application method that can be performed also for in-image measurement using reasonable resources. In-image measurement is understood here as colorimetric measurement of the entire printed image in a very large number (typically several thousand) of small pixels (typically a few millimeters in diameter) and the evaluation of the colorimetric values thus obtained from the individual pixels for calculating the control parameters for inking by the printing press. Another object of the present invention is to provide an ink application method so that the effects of all the printing inks involved, in particular that of the black printing ink, can be reliably separated.

The present invention provides a method of controlling the ink application in a printing press, in which a sheet (3) printed by the printing press (1) is colorimetrically measured in a number of pixels (4) with reference to a selected color coordinate system. Color difference vectors (ΔF) with respect to reference color vectors are previously defined or determined from a reference printed sheet are determined from the color vectors (F) thus obtained for each pixel and these color difference vectors (ΔF) are converted, using sensitivity matrices (S), into input parameters, in particular film thickness modification vectors (ΔD) for a control unit (9) for the inking mechanisms of the printing press (1). The inking of the printing press (1) is controlled on the basis of the input parameters, in particular film thickness modification vectors (ΔD), converted from the color difference vectors (ΔF). The method is characterized in that a separate sensitivity matrix (S) is determined for each measured pixel (4) of the sheet (3); the pixels (4) are classified by sensitivity classes ($K_{iK}$); the color difference vectors (ΔF) and the sensitivity matrices (S) of each pixel (4) of a sensitivity class ($K_{iK}$) are averaged; and the aforementioned input parameters, in particular film thickness modification vectors (ΔD) are calculated from the averaged color difference vectors ($\Delta F_{MK}$) and the averaged sensitivity matrices ($S_{MK}$) of all sensitivity classes ($K_{iK}$).

Particularly advantageous embodiments of and improvements on the present invention includes: (a) that the sensitivity matrices (S) are determined from previously known ink coverage values; (b) that for each pixel (4), at least one measured value (I) is obtained in the near infrared range; the color vector (F) determined for each pixel (4) is four-dimensional with three components of the color vector (F) being the coordinate values of an approximately equidistant color space and the fourth component being formed from the at least one measured value (I) in the near infrared range; the color difference vector (ΔF) measured for each pixel (4) is therefore four-dimensional; and the sensitivity matrix (S) determined for each pixel (4) is formed by the gradients of the four components of the four-dimensional color vector (F) according to the inks involved in the printing; (c) that for each pixel (4), at lesat one measured value (I) is obtained in the near infrared range; the color vector (F) determined for each pixel (4) is four-dimensional with three components of the color vector (F) being the coordinate values of an approximately equidistant color space and the fourth component being formed from the at least one measured value (I) in the near infrared range; the color difference vector (ΔF) measured for each pixel (4) is three-dimensional; and the sensitivity matrix (S) determined for each pixel (4) is formed by the gradients of the four components of the three-dimensional color vector (F) according to the inks involved in the printing; (d) that the color difference vectors (ΔF) and the sensitivity matrices (S) of the pixels (4) pertaining to each sensitivity class ($K_{iK}$) are subjected to weighted averaging with weighting factors (g1;g2), determined from the ink coverage or the pixel (4) and/or the color difference of the pixel (4) with respect to its neighboring pixels (4), being associated with each pixel (4); (e) a corresponding sensitivity matrix ($S_{iR}$) is computed for a predefined number of discrete screen value combinations ($R_{iR}$) of the inks involved in the printing process and stored in a screen-color table (RFT); the corresponding screen value combination (R) is computed for each pixel (4) from this calculated color vector (F); and the sensitivity matrix ($S_{iR}$) whose respective discrete screen value combination ($R_{iR}$) is closest to the screen value combination (R) computed for the pixel (4) from the screen color table (RFT) is associated with the pixel (4); and (f) that the sensitivity matrices ($S_{iR}$) are computed using a mathematical model of the underlying printing press (1) from measured values on the full tone areas printed with the printing press (1), also taking into account the characteristic curves of the printing press.

BRIEF DESCRIPTION OF THE DRAWINGS

The present invention is elucidated in the following with reference to the drawings, in which.

DETAILED DESCRIPTION

Figure 1:
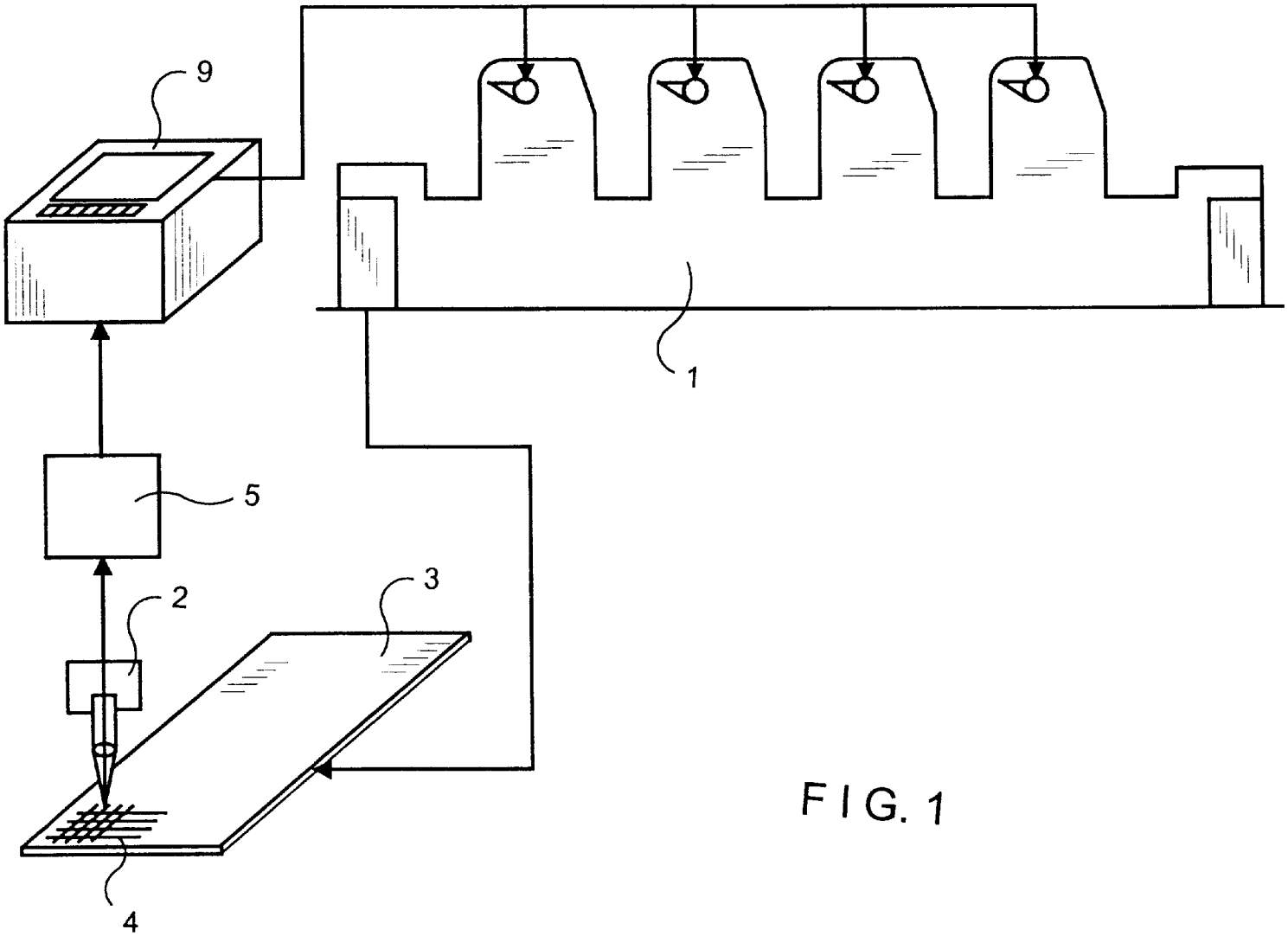
FIG. 1 shows a schematic diagram of an arrangement for open-loop or closed-loop control of a printing press.

According to FIG. 1, a printing press 1, in particular, a multicolor offset press, produces printed sheets 3, which have the desired printed image and optionally also print control elements. Sheets 3 are removed from the continuous printing process and taken to a spectrophotometric scanning device 2, which scans sheet 3 basically over its entire surface area pixel-by-pixel. The size of the individual pixels 4 is typically about 2.5 mm×2.5 mm, which corresponds to approximately 130,000 pixels for a regular-size sheet 3. The scanned values—typically spectral reflection values—obtained by scanning device 2 are analyzed in an analyzer 5 and processed to be used as input for a controller 9, assigned to printing press 1, which controls the inking mechanism of printing press 1 according to these input parameters. The input parameters are, at least in the case of an offset printing press, typically zonal film thickness changes for the individual inks involved in the printing operation. These input parameters (film thickness changes) are determined by comparing the scanned values or the parameters derived therefrom (color loci or color vectors) of a so-called OK sheet 3 with the corresponding values of a sheet 3 taken from the current printing run in the sense that the changes produced by the input parameters (film thickness changes) in the settings of the inking mechanisms of printing press 1 should result in the best possible approximation of the color impression of the currently produced sheet 3 to that of the OK sheet. Instead of an OK sheet 3, another reference can also be used for the comparison, for example, approximately corresponding predefined values or corresponding values obtained from the pre-printing stage.

In this general principle, the arrangement outlined above essentially corresponds to the printing press inking control arrangements and methods described in detail, for example, in European Patent No. 0 228 347 B2 and German Patent Application No. 44 15 486 A, both incorporated by reference herein, and therefore requires no further explanation for those skilled in the art.

Figure 2:
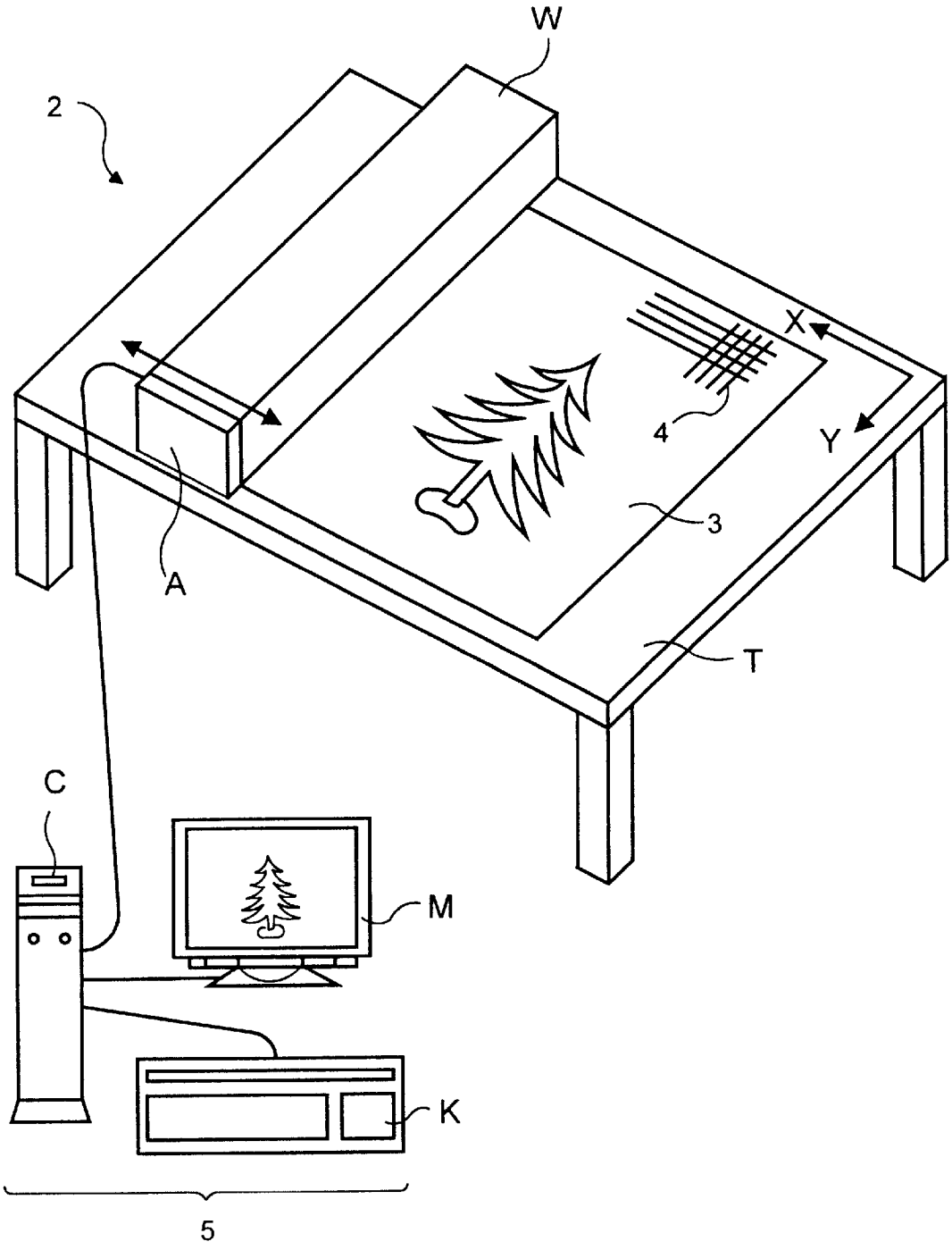
FIG. 2 shows a device for pixel-by-pixel scanning of printed sheets and for analyzing the scanning values for open-loop or closed-loop control of a printing press.

The basic design of scanner 2 and analyzer 5 are shown in FIG. 2. Scanner 2 includes a base in the form of a somewhat inclined rectangular measuring table T, on which sheet 3 to be measured can be positioned. A measuring carriage W is arranged on measuring table T, and a spectrophotometric measuring unit is in or on this carriage. Measuring carriage W extends over the entire depth of measuring table T in the direction of the y coordinates and is power movable linearly back and forth over its width in the direction of the x coordinates; the corresponding drive and control devices A are provided in measuring carriage W and on or under measuring table T.

Analyzer unit 5 includes a computer C with a keyboard K and a monitor M. Computer C works in conjunction with drive and control device A on measuring table T or in measuring carriage W, controls the movement of measuring carriage W and processes the scanned signals generated by the spectrophotometric measuring unit in measuring carriage W. The scanning signals or the values derived therefrom, typically the approximate color values of the individual pixels 4 can be displayed as an image on monitor M, for example. Furthermore, monitor M and keyboard K can be used for interactively influencing the analysis, which however is not the object of the present invention and therefore are not described in more detail.

The spectrophotometric measuring unit includes a plurality of reflection measuring heads linearly arranged along measuring carriage W and a spectrophotometer optically connected to these measuring heads via an optical fiber multiplexer. The measuring unit spectrophotometrically scans sheet 3 as measuring carriage W moves back and forth over the entire sheet surface pixel-by-pixel in a plurality (typically 320) of parallel linear tracks, with a plurality of individual pixels 4 in each track; the dimensions of these pixels in the direction of the x coordinates are defined by the velocity of measuring carriage W and the time resolution of the individual scanning operations. The dimensions of pixels 4 in the direction of the y coordinates are determined by the distance between the scanning tracks. Typically the dimensions of the individual scanned pixels are 2.5 mm×2.5 mm, which yields a total of about 130,000 pixels for a regular size printed sheet 3. After a full scanning operation, the reflection spectra of pixels 4 are available as scanning signals for each individual pixel 4 of sheet 3; computer C evaluates and further processes these signals as described below to determine the input parameters for printing press control device 9.

Scanners 2, which allow a printed sheet 3 to be measured densitometrically and spectrophotometrically in two dimensions pixel-by-pixel, are widely used in the graphic industry and therefore need no further explanation for those skilled in the art, particularly because, for the purposes of the present invention, sheet 3 can also be measured pixel-by-pixel using a manual colorimeter or a manual spectrophotometer. A particularly suitable scanner 2, which corresponds to the one briefly outlined above is described in full detail, for example, in German Patent Application No. 196 50 233.3, hereby incorporated by reference herein.

One important aspect of the present invention is that black ink is also taken into account in calculating the input parameters for the printing press control and the intermediary values needed for calculating these input parameters. For this reason, sheets 3 are measured not only in the visible spectral range (approx. 400–700 nm), but also at at least one point of the near infrared, where only the black ink has a non-negligible absorption. Thus, the reflection spectra of the individual pixels 4 are composed of the reflection values in the visible spectral range, typically 16 reflection values spaced 20 nm apart, and one reflection value in the near infrared range. Color values (color coordinates, color vectors, color loci) with reference to a selected color space are calculated from the reflection values of the visible spectral range. Preferably an equidistant color space is selected for this purpose according to the present invention, typically the L,a,b color space according to CIE (Commission Internationale de l'Éclairage). The calculation of the L,a,b color values from the spectral reflection values of the visible spectrum is standardized by CIE and therefore needs no further explanation. The reflection value in the near infrared is converted into an infrared value I, which qualitatively corresponds to brightness value L of the color space. This is done by analogy with the formula for L according to the equation $$I = 116 * \sqrt[3]{\frac{I_i}{I_{in}}} - 16$$

where $L_i$ is the infrared reflection measured in the respective pixel 4 and $I_{in}$ is the infrared reflection measured at an unprinted point of sheet 3. Like brightness value L, infrared value I can only assume values from 0 to 100. Color values L,a,b and infrared value I are calculated from the spectral reflection values by computer C. For the sake of completeness, it should be mentioned that color values L,a,b (or the corresponding values of some other color space) could also be determined without spectral scanning using suitable colorimetric devices.

The color and infrared values L,a,b and I obtained for each individual pixel 4 after scanning a sheet 3 form the point of departure for calculating the input parameters for printing press control unit 9. These computations are also performed in computer C. For the discussion that follows, the value quartet composed of the three color values L,a,b (or the corresponding values of another color system) and infrared value I determined for each pixel 4 will be referred to, in a simplified manner, as (four-dimensional) color vector F of the respective pixel 4, i.e.:

$$F=(L, a, b, I)$$

The concept "color locus" in the four-dimensional color space will be understood as the point whose four coordinates in the color space are the four components of the color vector. The color difference of a pixel 4 in relation to a reference pixel 4 or to a corresponding pixel 4 in a reference , typically of an OK sheet 3, is denoted as color difference vector ΔF, which is obtained from the equation $$\Delta F=(\Delta L,\Delta a,\Delta b,\Delta I)=F_i-F_r=(L_i-L_r,\ a_i-a_r, b_i-b_4, I_i-I_4)$$

where the values with the index I are those of pixel 4 in question and those with the index r are those of the components of the color vector of reference pixel 4 or the respective pixel 4 of OK sheet 3. The color vectors of pixels 4 of OK sheet 3 or of another reference are often also referred to as reference color vectors. The absolute value of the respective color difference vector ΔF is defined as the color difference ΔE of two pixels 4 or of a pixel 4 and the respective pixel 4 of OK sheet 3, i.e., $$\Delta E=|\Delta F|=\{(L_i-L_r)^2+(a_i-a_r)^2+(b_i-b_r)^2\div(I_i-I_r)^2)^{0.5}$$

where indices I and r have the above-mentioned meanings. Computer C calculates, for each pixel 4 of the current sheet, the color difference vector ΔF of color vectors F determined on this sheet and an OK sheet 3.

The input parameters to be determined for printing press control unit 9, i.e., the zonal relative film thickness changes for the individual inks involved in the printing process, will be represented vectorially below and collectively denoted as film thickness modification vector ΔD:

$$\Delta D=(\Delta D_c,\Delta D_g,\Delta D_m,\Delta D_s)$$

Indices c, g, m, and s represent the printing inks Cyan, Yellow, Magenta, and Black; the vector components with the corresponding indices are the relative film thickness changes for the inks identified by the index. The current film thicknesses themselves can be represented as film thickness vector D:

$$D=(D_c,D_g,\ D_m,D_s)$$

where the indices have the same meaning as above.

An offset printing press 1 is, as known, designed in zones, i.e., printing is performed in a series of parallel adjacent zones (typically 32), with dedicated inking mechanisms provided on printing press 1 for each zone; these mechanisms are controlled, at least for the purposes of the present invention, independently of one another. The effect of adjacent printing zones on one another and how it is taken into account by the printing machine controller is not the object of the present invention and will therefore not be discussed here. The following discussions concerning the actual control of printing press 1 and concerning the calculation of the input parameters for the printing machine controller always refer to one printing zone and apply equally to all printing zones.

According to the teaching of European Patent No. B2 0 228 347 mentioned in the preamble and also taking black ink into consideration according to the present invention, the relative film thickness changes ΔD required to compensate for a color deviation in relation to the reference (OK sheet 3) of the individual inks involved from color difference vectors ΔF in relation to the reference (OK sheet 3), determined from a current sheet 3, can be calculated by the formula $$\Delta F=S'\Delta D$$

where S is a sensitivity matrix, whose coefficients are the partial derivatives (gradients) of the four components L,a,b,I of color vector F by the four components $D_c$, $D_g$, $D_m$, $D_s$ of film thickness D:

$$S = \begin{pmatrix} \frac{dL}{dD_c} & \frac{dL}{dD_g} & \frac{dL}{dD_m} & \frac{dL}{dD_s} \\ \frac{da}{dD_c} & \frac{da}{dD_g} & \frac{da}{dD_m} & \frac{da}{dD_s} \\ \frac{db}{dD_C} & \frac{db}{dD_g} & \frac{db}{dD_m} & \frac{db}{dD_s} \\ \frac{dI}{dD_c} & \frac{dI}{dD_g} & \frac{dI}{dD_m} & \frac{dI}{dD_s} \end{pmatrix}$$

The coefficients of sensitivity matrix S are normally referred to as color value gradients. In the following discussions, the summary concept sensitivity matrix will be used for these 16 color value gradients.

Sensitivity matrix S is a linear equivalency model for the relationship between the film thickness modifications of the inks involved in the printing process and the resulting changes in color impression of pixel 4 printed with the modified film thickness values. Sensitivity matrix S is not the same for all color loci of the color space, but strictly speaking only applies in the immediate vicinity of a color locus, i.e., strictly speaking a separate sensitivity matrix S should be substituted in the equation ΔF=S*ΔD for each measured color vector F of individual pixels 4.

It should be pointed out that it is possible to form sensitivity matrix S only from components L, a, b of a three-dimensional color vector F. Component I can be omitted if the image structures of several pixels 4 are independent of one another with respect to the coverage of the inks involved, which is most frequently the case.

Assuming that sensitivity matrices S are known, the matrix equation $\Delta F = S * \Delta D$ can be solved with respect to $\Delta D$ using the known rules of matrix calculus ($\Delta D = S^{-1} * \Delta F$). The determination of the sensitivity matrices will be discussed in more detail later.

As stated above, each printing zone includes a large number, typically about 4000, of individual pixels. Experience shows that interfering factors do not affect the individual pixels to the same degree during printing, and not all pixels are affected by the same interfering factors. The film layer change calculated using one pixel may therefore result in full compensation for color derivation, but be either insufficient or cause a change in direction of or increase in the color deviation for other pixels (of the same zone). Since in the extreme case a different film thickness modification vector $\Delta D$ could correspond to each pixel, the matrix equation $\Delta F = S * \Delta D$ cannot be solved independently for each pixel. The individual matrix equations for the individual pixels must therefore be combined to a system of matrix equations equal in number to the number of pixels less 1, which then should be solved by the known methods of compensation computation, taking into account a boundary or secondary condition. Thus, in the case of 4000 pixels, a system of 4000 matrix equations, or 16,000 simple algebraic equations, results with the four unknowns $\Delta D_c$, $\Delta D_g$, $\Delta D_m$, $\Delta d_s$. As a secondary condition for solving this system of equations, it is required in practice that the mean square error be minimum. Mean square error is understood here as the mean of the squares of the color differences $\Delta E$ of the individual pixels remaining after the application of the corrected film thicknesses.

The above-mentioned 4000 matrix equations can be combined, for better clarity, as follows:

$$\{\Delta F\} = \{S\}' \Delta D$$

where $\{\Delta F\}$ is a column vector with 16,000 components ($\Delta L_1$, $\Delta a_1$, $\Delta b_1$, $\Delta I_1$, $\Delta L_2$, $\Delta a_2$, $\Delta b_2$, $\Delta I_2$, . . . $\Delta L_{4000}$, $\Delta a_{40000}$, $\Delta b_{4000}$, $\Delta I_{4000}$), $\{S\}$ is a matrix with 4 rows and 4000 columns, and $\Delta D$ is a column vector with the four unknowns $\Delta D_c$, $\Delta D_g$, $\Delta D_m$ and $\Delta D_s$ as components. The indices of the components of $\{\Delta F\}$ refer to pixels 4 1 to 4000, i.e., the components of $\{\Delta F\}$ are the components determined of color difference vectors $\Delta F$ of the individual pixels 4 with respect to the respective pixels 4 of the OK sheet. The rectangular matrix $\{S\}$ is obtained by arranging the 4000 sensitivity matrices S of the individual pixels 4, in a row, i.e., $\{S\} = (S_1, S_2, \ldots S_{4000})$.

According to the rules of compensation computation and with the above-mentioned secondary condition, the solution of this system of equations can be represented as follows: $\Delta D = \{Q\}^4 \{\Delta F\}$ where $\{Q\}$ is a rectangular matrix with 4000 columns and 4 rows, calculated as follows $$\{Q\} = \{S\}^{Ty} \{S\}^{-1} \cdot \{S\}^T$$

where $\{S\}^T$ and $\{S\}^{-1}$ are the transposed and inverse matrices of $\{S\}$, respectively.

As can be seen, while the film thickness vector $\Delta D$ can be calculated in this manner in principle, it requires a tremendous amount of computation resources and therefore time, which goes far beyond the limits of the practicable. In particular, sufficiently fast control, as required in practice, particularly in today's high-performance printing presses 1, cannot be achieved in this manner. The computation resources for determining 4000 sensitivity matrices (a total of 64,000 coefficients) for the individual pixels 4 is not even contemplated here, as it would take the method even further beyond the practicable.

This is where the present invention is advantageously used. The most important aspect of the present invention is to group the individual pixels 4 according to certain criteria and combine them into groups or classes, within which the color difference vectors and the sensitivity matrices are totaled and averaged, with the calculation being continued using the average values only. In this manner, the system of equations for the calculation of the film thickness modification vector is considerably simplified (typically 81 instead of 4000 matrix equations per printing zone), and can be solved using a reasonable amount of computation resources quickly enough for practical purposes (<1 minute for the entire sheet 3). A detailed description follows.

The visual color impression (quantitatively the color value, color locus or color vector) of a pixel 4 is determined in offset screen printing by the percentage screen value (ink coverage) of the inks involved and, to a lesser degree, by the film thicknesses of the inks. The screen values or ink coverages (0–100%) are determined by the respective printing plates and are practically unalterable. Only the film thicknesses of the inks involved can be made to influence the color impression and thus controlled. The terms "screen value" and "ink coverage" are used hereinafter interchangeably. The totality of all possible combinations R of percentage screen values of the inks involved (normally cyan, yellow, magenta, and black) is hereinafter referred to as a (four-dimensional) screen space.

Under certain printing conditions (characteristic curves of printing press 1, nominal film thicknesses, printing stock, inks used) each combination of screen values R corresponds to a precisely defined color impression or color vector F of pixel 4 printed with this screen value combination R; thus, there is a unique correspondence between screen value combination R and color locus or color vector F; the screen space can be uniquely mapped to the color space; in this case the color space is not fully occupied, since it also contains color loci that cannot be printed. There is, however, a unique correspondence in the reverse sense. Color vector F pertaining to any desired screen value combination R can be empirically determined using printing proofs or calculated using a suitable model describing the printing process with sufficient precision under the given printing conditions. A suitable model is provided, for example, by the known Neugebauer equations for offset printing. The model assumes that the reflection spectra of the individual full-tone colors, some overprinting of full tones and some screen fields of all the inks involved in the printing process at nominal ink film thickneses are known. These reflection spectra can be measured in a simple manner using a printing proof. If the characteristic curves of printing press 1 are known, simple measurements of the full tones are sufficient.

The (16) coefficients of sensitivity matrix S pertaining to any desired screen value combination R can be determined, using the above model, in the known manner, for any screen value combination. To do so, it is only necessary to modify the nominal film thicknesses of the inks involved, preferably individually by 1%, for example, and, using these modified film thicknesses, to compute the corresponding color vectors and color difference vectors with respect to the color vector resulting from the nominal film thicknesses. These color difference vectors ΔF and the corresponding film thickness modification vectors ΔD are substituted into the equation ΔF=S*ΔD, which is then solved by the coefficients of sensitivity matrix S.

When determining the coefficients of sensitivity matrix S, the ink coverage values of pixels 4 can also be used. If the ink coverage values are known from the pre-print stage, no measurement on the printing proofs is required (with an exception for full tones).

According to the present invention, color vector F and the respective sensitivity matrix S are only computed in advance and saved in a table for a limited number of possible screen value combinations R. This table containing the totality of all sensitivity matrices S and color vectors F is referred to hereinafter as the RFT screen color table.

To calculate the film thickness modification vectors ΔD from the equation ΔF=S*ΔD, as stated above the sensitivity matrix S should be known which pertains to the respective color locus or color vector F. In order to arrive at this sensitivity matrix, according to the present invention, the corresponding screen value combination R is calculated, according to a particularly advantageous method to be described in more detail later, from color vector F of the respective pixel, and the corresponding sensitivity matrix S is taken from the previously calculated RFT screen color table using this screen value combination R. In this manner, the required sensitivity matrices can be quickly determined without using excessive computing resources.

According to another idea of the present invention, a number of, for example, 1296 equidistant discrete screen value combinations $R_{iR}$ (six discrete screen percentage values $A_C$, $A_G$, $A_M$, $A_S$ for each of the inks cyan, yellow, magenta, and black) are defined in the screen space for this purpose.

| i | o | 1 | 2 | 3 | 4 | 5 |
|---|---|---|---|---|---|---|
| $A_C$ | 0 | 20 | 40 | 60 | 80 | 100% |
| $A_G$ | 0 | 20 | 40 | 60 | 80 | 100% |
| $A_M$ | 0 | 20 | 40 | 60 | 80 | 100% |
| $A_S$ | 0 | 20 | 40 | 60 | 80 | 100% |

Each of these 1296 discrete screen value combinations $R_{iR}$ is numbered with a unique screen index iR according to the following formula:

$$iR=i(A_C)'5^0+i(A_G)*5^1+i(A_M)'5^2+i(A_S)^{\tau}5^3$$

$l(A_c)$ is defined as the value of index I for the respective discrete screen value of the respective ink. For each of these 1296 discrete screen value combinations $R_{iR}$, a sensitivity matrix $S_{iR}$ is computed and stored in the RFT screen color table. Calculated color vector $F_{iR}$ pertaining to the discrete screen value combination $R_{iR}$ is also stored in the RFT table. Thus the RFT screen color table contains a total of 1296 color vectors $F_{iR}$ and 1296 corresponding sensitivity matrices $S_{iR}$.

The screen space is preferably quantized in two stages. In the first stage, the corresponding color vectors and the corresponding sensitivity matrices are calculated for only 256 discrete screen value combinations (according to four discrete screen percentage values 0%, 40%, 80%, 100%) for each of the inks cyan, yellow, magenta, and black) using the offset printing model. In the second stage, the color vectors and sensitivity matrices are calculated for the remaining screen percentage values 20% and 60% by linear interpolation from the color vectors and sensitivity matrices of the 16 corresponding closest discrete screen value combinations. Thus a total of 1296 discrete screen value combinations $R_{iR}$ are obtained again with 1296 corresponding discrete color vectors $F_{iR}$ and 1296 corresponding sensitivity matrices $S_{iR}$. Of course, the screen space can also be reduced to another number of discrete screen combinations, for example, 625 or 2401, but the number 1296 represents an optimum compromise in practice between accuracy and needed computing resources.

Now the sensitivity matrix $S_{iR}$, whose corresponding discrete screen value combination $R_{iR}$ is closest to the screen value combination R calculated from color vector F, is associated with a color vector F determined for a pixel 4. In other words, the calculated screen value combination R is replaced with the closest discrete screen value combination $R_{iR}$ and is associated with the sensitivity matrix $S_{iR}$ previously calculated for this discrete screen value combination $R_{iR}$.

In another approach, the screen space is quantized by dividing it into a number of subspaces. All color vectors F whose calculated corresponding screen value combinations R fall into the same subspace are associated with the same sensitivity matrix $S_{iR}$ precalculated for this subject. The subspaces are defined by the following six value ranges of the percentage screen components (ink coverages) of the four inks involved:

0–10, 10–30, 30–50, 50–70, 70–90, 90–100%

According to another aspect of the present invention, the (four-dimensional, including infrared value I) color space is also subjected to quantization to obtain screen value combination R from color vector F, i.e., subdivided into a number of subspaces. For this purpose, a number of discrete color loci, each with a discrete coordinate value, are defined in the color space. The four-dimensional color space can be quantized, for example, by the fact that each dimension L, a, b, I of the color space can only assume 11 discrete values, resulting in a total of 14,641 discrete color loci $F_{iF}$.

| i | 0 | 1 | 2 | 3 | 4 | 5 | 6 | 7 | 8 | 9 | 10 |
|---|---|---|---|---|---|---|---|---|---|---|---|
| L | 0 | 10 | 20 | 30 | 40 | 50 | 60 | 70 | 80 | 90 | 100 |
| a | −75 | −60 | −45 | −30 | −15 | 0 | 15 | 30 | 45 | 60 | 75 |
| b | −45 | −30 | −15 | 0 | 15 | 30 | 45 | 60 | 75 | 90 | 105 |
| I | 0 | 10 | 20 | 30 | 40 | 50 | 60 | 70 | 80 | 90 | 100 |

Each of these 14,641 discrete color loci $F_{iF}$ is numbered according to the following formula with a unique color locus index iF:

$$iF=i(L)*11^0+i(a)*11^1+i(b)*11^2+i(I)*11^3$$

For these discrete color loci $F_{iF}$ of the color space, the respective screen value combinations $R_{iF}$ are computed according to a special computation method alucidated below and, unless they coincide with a discrete screen value combination $R_{iR}$, replaced with the closest discrete screen value combination $R_{iR}$. Thus a unique pre-calculated mapping of the 14,641 discrete color loci $F_{iF}$ of the (four-dimensional) color space to the 1296 discrete screen value combinations $R_{iR}$, of screen space $F_{iF}$ is obtained. This mapping is, as stated before, pre-calculated and saved in a screen index table known as RIT.

For the purposes of determining the screen value combinations R from color vectors F determined for pixels 4, each color vector F determined for a pixel 4 is replaced with the closest discrete color locus $F_{iF}$. Then the discrete screen value combination $R_{iR}$, associated with this discrete color locus $F_{iF}$ is taken from the RIT screen index table and the corresponding sensitivity matrix $S_{iR}$ is read from the RFT screen color table using this screen value combination and associated with color vector F. In this manner, the sensitivity matrix S can be determined for any desired color factor F with relatively little computing resources and therefore quickly; however, this sensitivity matrix can only be selected from one of the 1296 pre-calculated sensitivity matrices $S_{iR}$. This is, however, sufficient in practice.

For the above, it was assumed that the corresponding screen value combinations R can be calculated from color vectors F. How this can be accomplished in a particularly advantageous manner according to the present invention is the object of the following discussions.

Initially, the color space is divided into 81 subareas $T_{iT}$ for this purpose as follows:

| i | 0 | 1 | 2 |
|---|---|---|---|
| L(0 . . . 120) | 0 . . . 20 . . . 40 | 40 . . . 60 . . . 80 | 80 . . . 100 . . . 120 |
| a(−90 . . . +90) | −90 . . . −60 . . . −30 | −30 . . . 0 . . . +30 | +30 . . . +60 . . . +90 |
| b(−60 . . . +120) | −60 . . . −30 . . . 0 | 0 . . . +30 . . . +60 | +60 . . . +90 . . . +120 |
| I(0 . . . 120) | 0 . . . 20 . . . 40 | 40 . . . 60 . . . 80 | 80 . . . 100 . . . 120 |

Each of the total of 81 subareas $T_{iT}$ is then uniquely numbered with a partial area index iT defined by the following formula:

$$iT=i(L)*3^0+i(a)*3^1+i(b)*3^2+i(I)*3^3$$

Then, in each subarea $T_{iT}$, the relationship between the color vector F and the corresponding screen value combination R written as screen vector A is linearly approximated using the following matrix equation:

$$A=U_{iT}*F$$

where A denotes the screen vector with the screen percentage values $A_C$, $A_G$, $A_M$, $A_S$ of the four inks involved as components and $U_{iT}$, is a conversion matrix with 16 coefficients, which are the partial derivatives (gradients) of the screen vector components by the color vector components. If the conversion matrices $U_{iT}$, of the individual subareas $T_{iT}$ are known, the corresponding screen vector A or the corresponding screen vector combination R can be calculated for each color vector F.

Thus the problem is reduced to calculating conversion matrices $U_{iT}$ for the individual subareas $I_{iT}$ or, more precisely, for color vectors $F_{iT}$ from their mid-points. The conversion matrices are calculated using a weighted linear compensation computation with the values of the RFT screen color table, to be explained below, i.e., the 1296 discrete screen value combinations $R_{iR}$ and the corresponding discrete color vectors $F_{iR}$. For the compensation calculation, basically only the inversion of a 4×4 matrix is required for each subarea $T_{iT}$. The weight of the interpolation points, i.e., the discrete color loci $F_{iR}$ of the RFT screen color table, for the compensation computation is determined using a suitable function with the color difference between the interpolation points and the corresponding color vector $F_{iT}$ as a parameter. The compensation computation is linear, i.e., discontinuities occur at the transitions between the individual subareas $T_{iT}$, but these are irrelevant in practice.

The actual control process for inking printing press 1 is described in detail below.

At the beginning of a printing job, the RFT screen color table and the RIT screen index table area calculated and saved according to the explanations above. Once determined and saved in a storage medium, the RFT and RIT tables can, of course, be retrieved from this medium. The appropriate discrete sensitivity matrix S can be associated with color vectors F, determined for the individual pixels 4 using the two tables RFT, RIT, without the use of substantial computing resources.

The current sheet 3 is then removed from the printing process and measured using scanner 2 as described above pixel-by-pixel, with color vector F and color difference vector ΔF with respect to the corresponding pixel 4 of a previously similarly measured OK sheet 23 being determined for each pixel 4 in computer 5. The total number of pixel 4 is, for example, approximately 130,000, so that for the usual 32 printing zones, the color vectors and color difference vectors of about 4000 pixels 4 per printing zone must be processed. The following discussions apply equally for one printing zone and for all the printing zones.

An important aspect of the present invention is that pixels 4 are classified by certain criteria, the measurement data of pixels 4 pertaining to one class are averaged, and only the average values are processed further. Measurement data are understood here as the calculated color vectors F and color difference vectors ΔF. To classify pixels 4, sensitivity classes are formed. The sensitivities (sensitivity matrices S) and color vectors F are similar for each sensitivity class, and therefore averaging is permissible. Film thickness modification vector ΔD, which is required for controlling printing press 1, is then calculated so that the mean square error over all the sensitivity classes is minimum. Mean square error is understood here as the average of the squares of the average color differences remaining after the application of the corrected color film thicknesses of pixels 4 of the individual classes.

The ranges of the sensitivity classes are preferably defined in the screen space. For example, 16–256 classes may be provided. The more classes are defined, the fewer errors occur by averaging, while the computing resources needed increase. The definition of 81 classes, obtained by subdividing the screen space into 81 subspaces according to the following scheme, has proven to be a feasible compromise.

| n | 0 | 1 | 2 |
|---|---|---|---|
| $A_C$ | 0% . . . 30% | 30% . . . 70% | 70% . . . 100% |
| $A_G$ | 0% . . . 30% | 30% . . . 70% | 70% . . . 100% |
| $A_M$ | 0% . . . 30% | 30% . . . 70% | 70% . . . 100% |
| $A_S$ | 0% . . . 30% | 30% . . . 70% | 70% . . . 100% |

Each of these 81 subspaces or sensitivity classes $K_{iK}$ is uniquely numbered using a class index iK as follows:

$$iK=n(A_C)'3^0+n(A_G)'3^1+n(A_M)'3^2+n(A_S)'3^3$$

The screen space includes, as explained below, 1296 discrete screen value combinations $R_{iR}$. Thus, each of the 81 subspaces includes exactly 16 screen value combinations $R_{iR}$ and thus each sensitivity class $K_{iK}$ includes 16 (similar) sensitivity matrices $S_{iR}$.

Now the respective screen index iR is determined by the method described below using RIT screen index table for each pixel 4 from color vector F determined for it and therefrom the pixel is classified into one of the 81 sensitivity classes $K_{iK}$. Using screen index iR and the RFT screen color table, the sensitivity matrix S pertaining to color vector F of pixel 4 is determined. Thus, after these steps, the color vector F, the color difference vector ΔF, the screen index iR, the sensitivity matrix S, and the class index iK are available for each of the approximately 4000 pixels 4 of a printing zone. Screen index iR defines the screen value combination R, i.e., the percentage screen components (ink coverages) of the inks involved for pixel 4; class index iK defines to which sensitivity class pixel 4 belongs.

Subsequently pixels 4 or their color difference vectors ΔF are subjected to a weighting process, which takes into account the effect of ink coverage and positioning errors.

For the subsequent averaging, it is advantageous if pixels 4 with relatively low ink coverage values are given a low weight or no weight at all; in particular, pixels 4 with ink coverage values less than 10% should not be considered. Consequently, a first ink coverage-dependent weighting factor g1 can be defined as follows:

$$g1=1 \text{ for ink coverages} \geqq 10\% \text{ and } g1=0 \text{ for ink coverages} < 10\%$$

Since color values L, a, b, I are approximately proportional to the ink coverages, the first weighting factor is preferably defined using the color difference ΔE of the pixel with respect to an unprinted spot of sheet 3 (paper white) as follows:

$$g1=1 \text{ for } \Delta E_p^2 24\ 5^2 \text{ and } g1=0 \text{ for } \Delta E_p^2 < 5^2,$$

where $\Delta E_p^2$ is the square of the color difference of pixel 4 with respect to the unprinted spot of sheet 3 (paper white).

Another variant for determining weighting factor g1 attributes to this factor the maximum value 1 when the sum of ink coverages of the respective pixels 4 is less than a predefined threshold, for example, 250. Otherwise weighting factor g1 has a smaller value, in particular zero value. A combination of the above-mentioned variants is also conceivable.

The effect of positioning errors is taken into account through a second weighting factor g2. For this purpose, it is assumed that pixels 4 are relatively insensitive to positioning errors in a homogenous environment. A homogenous environment is understood as an environment where the color differences between pixel 4 and its eight neighboring pixels 4 are relatively small. In this case, the second weighting factor is set at g2=1. With increasing color differences the second weighting factor is reduced. The second weighting factor g2 can be determined as follows, for example:

$$g2=1 \text{ for } \Delta E^M 23\ 8 \text{ and } g2=(8/\Delta E^M) \text{ for } \Delta E^M > 8$$

where $\Delta E^M$ is the sum of the color differences of pixel 4 with respect to its eight neighboring pixels 4. A preferred definition of the second weighting factor g2, since it is easier to calculate, is given by the following relationships:

$$g2=1 \text{ for } \Delta E^{M2} 23\ 8 \text{ and } g2=(8/\Delta E^{M2})^{0.5} \text{ for } \Delta E^{M2} > 8$$

where $\Delta E^{M2}$ is the sum of squares of the color differences of pixel 4 with respect to its eight neighboring pixels 4.

In determining weighting factor g2, the difference of ink coverage values with respect to the neighboring pixels 4 can also be used, with weighting factor g2 being assigned a smaller value tending to zero with increasing differences.

The two weighting factors g1 and g2 are combined into an individual combined weighting factor g for each pixel 4 according to the formula g=g1*g2. Now the color difference vectors ΔF of the individual pixels 4 and the respective sensitivity matrices S are multiplicatively weighted with this combined weighting factor g. The weighted color difference vectors and sensitivity matrices of the individual pixels 4 are hereinafter denoted as $\Delta F_g$ and $S_g$, respectively.

Averaging and normalization follows for all pixels of each sensitivity class according to the following formulas:

$$\Delta F_{MK}=(\Sigma_k(\Delta F_g))/\Sigma_k(g);\ S_{MK}=(\Sigma_k(S_k))/\Sigma_k(g)$$

The sums are formed over all the pixels of one class.

After this averaging, 81 mean color difference vectors $\Delta F_{MK}$ and 81 mean sensitivity matrices $S_{MK}$ are available for each printing zone. These are substituted, as described previously, in the basic equation ΔF=S*ΔD and result in a system of 81 matrix equations, which must be solved by the unknown film thickness modification vector ΔD. The system is solved again using a weighted linear compensation computation with the secondary condition that the mean square error should be minimum, the mean square error being defined as the average of the squares of the mean color differences $\Delta E_{MK}$ of the individual sensitivity classes remaining after the application of the film thicknesses corrected by ΔD.

The system of equations appears as follows:

$$(\Delta F_z\}=\{S_g\}*\Delta D$$

where $\{\Delta F_z\}$ is a column vector with 4×81 components, obtained by arranging the 81 vectors $\Delta F_{MK}$ each with its 4 components one below the other. $\{S_z\}$ is a matrix with 4 rows and 81 columns, obtained by arranging the 81 sensitivity matrices $S_{MK}$ horizontally in a row. ΔD is a column vector with the four unknowns $\Delta D_c$, $\Delta D_g$, $\Delta D_m$, and $\Delta D_s$ as components.

According to the rules of compensation computation and with the aforementioned secondary condition, the solution of this system of equations can be written as follows:

$$\Delta D=\{Q_z\}*\{\Delta F_z\}$$

where $\{Z_z\}$ is a rectangular matrix with 81 columns and 4 rows, calculated as follows:

$$\{Q_g\}=\{S_l\}^{T*}\{S_g\}^{-1*}\{S_z\}^T$$

where $\{S_z\}^T$ and $\{S_x\}^{-1}$ are the transposed and inverse matrices of $\{S_g\}$, respectively.

As a result of all these calculations, the desired film thickness modification vector ΔD with its components $\Delta D_c$, $\Delta D_g$, $\Delta D_m$, and $\Delta D_s$ are obtained for each printing zone, which are then supplied to control unit 9 as input parameters and cause the required adjustment of the inking mechanism of printing press 1 so that the aforementioned mean square error is minimum in each printing zone.

What is claimed is:

1. A method of controlling an ink application in a printing press, a sheet being printed by the printing press, the method comprising:

colorimetrically measuring the sheet in a plurality of pixels with reference to a selected color coordinate system to obtain a color vector for each pixel;

determining a color difference vector from the color vector for each pixel with respect to a reference color vector for the pixel, the reference color vector being previously defined or determined from a reference printed sheet;

determining a sensitivity matrix for each pixel;

classifying each pixel by a plurality of sensitivity classes;

averaging the color difference vector and the sensitivity matrix of each pixel within one of the plurality of sensitivity classes to form an averaged color difference vector and an averaged sensitivity matrix for each of the plurality of sensitivity classes; and calculating input parameters as a function of the averaged color difference vectors and the averaged sensitivity matrices for the plurality of sensitivity classes, the ink application being controlled as a function of the input parameters.

2. The method as recited in claim 1 wherein the sensitivity matrices are determined from predetermined ink coverage values.

3. The method as recited in claim 1 wherein the color vector for each pixel includes at least one measured value obtained in the near infrared range, the color vector being four-dimensional with three components of the color vector being coordinate values of an approximately equidistant color space and a fourth component being formed from the at least one measured value in the near infrared range so that the color vector has four components, and wherein the color difference vector measured for each pixel is four-dimensional; and the sensitivity matrix determined for each pixel is formed by gradients of the four components.

4. The method as recited in claim 1 wherein the color vector for each pixel includes at least one measured value obtained in the near infrared range, the color vector for each pixel being four-dimensional with three components of the color vector being coordinate values of an approximately equidistant color space and a fourth component being formed from the at least one measured value in the near infrared range and wherein the color difference vector for each pixel is three-dimensional; and the sensitivity matrix determined for each pixel is formed by gradients of the three components.

5. The method as recited in claim 1 wherein the averaging includes a weighted averaging with at least one weighting factor, the at least one weighting factor being a function of at least one of an ink coverage and a color difference of the pixel with respect to at least one neighboring pixel.

6. The method as recited in claim 5 wherein the at least one weighting factor includes a first weighting factor for a respective pixel, the first weighting factor having a value 1 if an average value or one of the ink coverages of the respective pixel exceeds a predefined first threshold value and otherwise the first weighting factor has an other value less than the value 1.

7. The method as recited in claim 6 wherein the other value is zero and the predefined threshold value is ten percent.

8. The method as recited in claim 5 wherein the at least one weighting factor includes a first weighting factor for a respective pixel, the first weighting factor forming a maximum value if a sum of the ink coverage of the respective pixel is less than a predefined threshold and otherwise the weighting factor is an other value less than the value 1.

9. The method as recited in claim 8 wherein the maximum value is one, the other value is zero and the predefined threshold is 250.

10. The method as recited in claim 1 wherein the averaging includes a weighted averaging using at least a first weighting factor, the first weighting factor being a function of a color difference with respect to an unprinted spot of the printed sheet; the first weighting factor equalize a value 1 if the color difference of a respective pixel exceeds a predefined threshold value, and otherwise the first weighting factor obtains an other value less than the value 1.

11. The method as recited in claim 10 wherein the predefined threshold value equals five and the other value equals one.

12. The method as recited in claim 5 wherein for each pixel, color differences with respect to other pixels in an immediate proximity are determined; a second weighting factor of each pixel equaling a value 1 if a sum of the color differences is less than a predefined threshold value, and otherwise the second weighting factor obtains a value approaching zero as the sum of the color differences increases or as a difference in the ink coverages with respect to the other pixels increases.

13. The method as recited in claim 12 wherein the predefined threshold value equals 8.

14. The method as recited in claim 12 wherein the at least one weighting factor includes a linked weighting factor formed as a function of the second weighting factor and a first weighting factor calculated on the basis of the ink coverages or of the color difference of the pixel with respect to an unprinted spot of the sheet.

15. The method as recited in claim 1 wherein determining the sensitivity matrix includes computing a corresponding sensitivity matrix for a predefined number of discrete screen value combinations of inks involved in a printing process and storing the corresponding sensitivity matrix in a screen-color table, computing a corresponding computed screen value combination for each pixel from the color vectors, and assigning the sensitivity matrix whose respective discrete screen value combination is closest to the computed screen value combination to the pixel.

16. The method as recited in claim 15 wherein a second number of discrete color loci is defined in a color space extended to four dimensions by an infrared component, the corresponding computed screen value combination being computed for each of the discrete color loci, the corresponding computed screen value combination being replaced with a closest of the discrete screen value combination for each of the discrete color loci, associations of discrete color loci with the discrete screen value combination being saved in a screen index table.

17. The method as recited in claim 16 wherein the color vector determined for a respective pixel is replaced with a closest discrete color locus; the screen value combination associated with the discrete color locus being taken from the screen index table and the sensitivity matrix being taken from the screen color table.

18. The method as recited in claim 1 wherein the sensitivity matrices are determined as a function of a mathematical model of the printing press, the mathematical model being a function of measured values on full tone areas printed with the printing press and characteristic curves of the printing press.

19. The method as recited in claim 1 wherein the input parameters are film thickness modification vectors for a control unit for inking mechanisms of the printing press.

* * * * *